US009705199B2

(12) United States Patent
Apostolos et al.

(10) Patent No.: US 9,705,199 B2
(45) Date of Patent: Jul. 11, 2017

(54) QUASI TEM DIELECTRIC TRAVELLING WAVE SCANNING ARRAY

(71) Applicant: AMI Research & Development, LLC, Windham, NH (US)

(72) Inventors: John T. Apostolos, Lyndeborough, NH (US); William Mouyos, Windham, NH (US); Benjamin McMahon, Nottingham, NH (US); Brian Molen, Windham, NH (US); Paul Gili, Mason, NH (US)

(73) Assignee: AMI Research & Development, LLC, Windham, NH (US)

( * ) Notice: Subject to any disclaimer, the term of this patent is extended or adjusted under 35 U.S.C. 154(b) by 0 days.

(21) Appl. No.: 14/702,147

(22) Filed: May 1, 2015

(65) Prior Publication Data

US 2015/0318621 A1 Nov. 5, 2015

Related U.S. Application Data

(60) Provisional application No. 61/987,781, filed on May 2, 2014.

(51) Int. Cl.

| | |
|---|---|
| ***H01Q 3/34*** | (2006.01) |
| ***H01Q 13/20*** | (2006.01) |
| ***H01Q 3/44*** | (2006.01) |
| ***H01Q 21/24*** | (2006.01) |
| *H01P 5/18* | (2006.01) |
| *H01P 5/19* | (2006.01) |
| *H01Q 21/00* | (2006.01) |
| *H01Q 21/06* | (2006.01) |

(52) U.S. Cl.

CPC ..... *H01Q 13/206* (2013.01); *H01Q 3/34* (2013.01); *H01Q 3/443* (2013.01); *H01Q 21/24* (2013.01); *H01P 5/185* (2013.01); *H01P 5/19* (2013.01); *H01Q 21/0037* (2013.01); *H01Q 21/0075* (2013.01); *H01Q 21/065* (2013.01)

(58) Field of Classification Search

CPC ..... H01Q 13/20; H01Q 3/34

See application file for complete search history.

(56) References Cited

U.S. PATENT DOCUMENTS

| | | | |
|---|---|---|---|
| 3,258,774 | A | 6/1966 | Kinsey |
| 5,001,492 | A | 3/1991 | Shapiro et al. |
| 5,349,364 | A | 9/1994 | Bryanos et al. |
| 5,754,293 | A | 5/1998 | Farhadiroushan |
| 5,796,881 | A | 8/1998 | Manasson et al. |

(Continued)

FOREIGN PATENT DOCUMENTS

| | | |
|---|---|---|
| DE | 102010040793 | 3/2012 |

OTHER PUBLICATIONS

International Search Report and Written Opinion for International Application No. PCT/US2015/028849 filed on May 1, 2015 by AMI Research & Development, LLC mail date Aug. 17, 2015, 12 pages.

(Continued)

*Primary Examiner* — Dameon E Levi
*Assistant Examiner* — Andrea Lindgren Baltzell
(74) *Attorney, Agent, or Firm* — Cesari and McKenna, LLP

(57) ABSTRACT

A dielectric travelling wave antenna (DTWA) using a TEM mode transmission line and variable dielectric substrate.

14 Claims, 11 Drawing Sheets

(56) References Cited

U.S. PATENT DOCUMENTS

| | | | | |
|---|---|---|---|---|
| 5,978,524 | A | 11/1999 | Bischel et al. | |
| 6,037,910 | A | 3/2000 | Solbach et al. | |
| 6,147,648 | A | 11/2000 | Granholm et al. | |
| 6,232,920 | B1 | 5/2001 | Brookner et al. | |
| 6,359,599 | B2 | 3/2002 | Apostolos | |
| 6,396,440 | B1 | 5/2002 | Chen | |
| 6,486,850 | B2 | 11/2002 | Apostolos | |
| 6,563,398 | B1 | 5/2003 | Wu | |
| 7,068,129 | B2 | 6/2006 | Higgins et al. | |
| 2002/0047751 | A1* | 4/2002 | Ishikawa | H01P 1/16 333/1 |
| 2005/0093737 | A1 | 5/2005 | Schoebel | |
| 2012/0206310 | A1* | 8/2012 | Apostolos | H01Q 13/28 343/771 |

OTHER PUBLICATIONS

Huang et al., "Novel Impedance Matching Scheme for Patch Antennas," Progress in Electromagnectics Research Letters, vol. 14, 155-163, 2010.

Busuioc et al., "High Efficiency Antenna Array With Optimized Corporate Hybrid Feed" IEEE 2006, pp. 1503-1506.

Radar Basics—Feeding Systems of Phased Array Antenna, Feeding Systems of Phased Arrays—Active Antenna, radartutorial.eu, www.radartutorial.ed/06.antennas/an15.en.html, printed from the internet Jan. 3, 2014, 1 page.

Host et al., Low Cost Beam-Steering Approach for a Series-Fed Array, 2013 IEEE International Symposium on Phased Array Systems and Technology, Oct. 15-18, 2013, pp. 293-300.

Host et al., Novel Phased-Array Scanning Employing a Single Feed Without Using Individual Phase Shifters, IEEE Antennas and Propagation Magazine, vol. 55, No. 4, Aug. 2013, pp. 290-296.

* cited by examiner

QUASI TEM DIELECTRIC TRAVELLING WAVE SCANNING ARRAY

CROSS REFERENCE TO RELATED APPLICATIONS

The present application claims the benefit of U.S. Provisional Patent Application Ser. No. 61/987,781, entitled "Quasi Tem Dielectric Travelling Wave Scanning Array" which was filed on May 2, 2014 the entire contents of which is hereby incorporated by reference.

BACKGROUND

Technical Field

This patent relates to series-fed phased array antennas and in particular to a coupler that includes a transmission line structure disposed over an adjustable dielectric substrate.

Background Art

Phased array antennas have many applications in radio broadcast, military, space, radar, sonar, weather satellite, optical and other communication systems. A phased array is an array of radiating elements where the relative phases of respective signals feeding the elements may be varied. As a result, the radiation pattern of the array can be reinforced in a desired direction and suppressed in undesired directions. The relative amplitudes of the signals radiated by the individual elements, through constructive and destructive interference effects, determines the effective radiation pattern. A phased array may be designed to point continuously in a fixed direction, or to scan rapidly in azimuth or elevation.

There are several different ways to feed the elements of a phased array. In a series-fed arrangement, the radiating elements are placed in series, progressively farther and farther away from a feed point. Series-fed arrays are thus simpler to construct than parallel arrays. On the other hand, parallel arrays typically require one feed for each element and a power dividing/combining arrangement.

However, series fed arrays are typically frequency sensitive therefore leading to bandwidth constraints. This is because when the operational frequency is changed, the phase between the radiating elements changes proportionally to the length of the feedline section. As a result the beam in a standard series-fed array tilts in a nonlinear manner.

SUMMARY

As will be understood from the discussion of particular embodiments that follows, we have realized that a series fed antenna array may utilize a number of coupling taps or radiating elements, typically with one or two taps per interstitial position in the array. The taps extract a portion of the transmission power from one or more Transverse Electromagnetic Mode (TEM) transmission lines disposed on an adjustable dielectric substrate.

The TEM transmission line may be a parallel-plate, microstrip, stripline, coplanar waveguide, slot line, or other low dispersion TEM or quasi-TEM transmission line.

In one embodiment, the scan angle of the array is controlled by adjusting gap between layers of a substrate having multiple dielectric layers. A control element is also provided to adjust a size of the gaps. The control element may, for example, control a piezoelectric actuator, electroactive material, or a mechanical position control. Such gap size adjustments may further be used to control the beamwidth and direction of the array.

Each tap may itself constitute a radiating antenna element. In alternate embodiments each tap may feed a separate radiating element. In these alternate embodiments, the radiating elements may be a patch radiator disposed on the same substrate as the transmission line, or some other external radiator may be used.

In one refinement, delay elements for a number of feed points are positioned along the transmission line taps and to provide progressive delays, to increase the instantaneous bandwidth of the array. The delay elements may be embedded in to or on the same structure as the TEM transmission line.

BRIEF DESCRIPTION OF THE DRAWINGS

The description below refers to the accompanying drawings, of which.

DETAILED DESCRIPTION OF AN EMBODIMENT

Antenna array elements are fed in series by a coupling feed structure formed from a Transverse Electromagnetic Mode (TEM) or quasi-TEM transmission line disposed adjacent an adjustable substrate. The adjustable substrate may be formed of two or more dielectric layers, with the dielectric layers having a reconfigurable gap between them. The transmission line may be a low dispersing microstrip, stripline, slotline, coplanar waveguide, or any other quasi-TEM or TEM transmission line structure. The gaps introduced in between the dielectric layers provide variable properties, such as a variable dielectric constant (variable epsilon structure) to control the scanning of the array. Alternatively, a piezoelectric or ElectroActive Polymer (EAP) actuator material may provide or control the gaps between layers, allowing these layers to expand, or causing a gel, air, gas, or other material to compress. Any other arrangement may be used to enable the dielectric constant of the adjacent structure to change via the adjustable gaps.

Figure 1A:
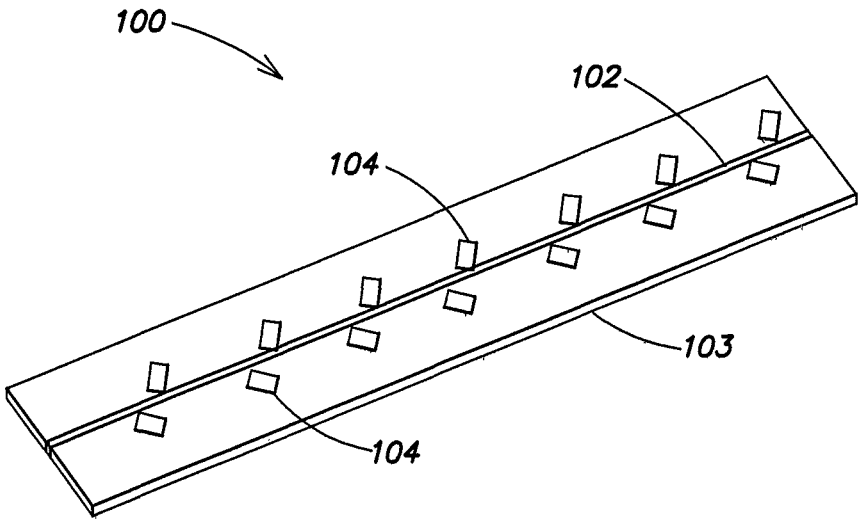
FIG. 1A is a isometric top view of TEM transmission line based antenna coupler.
Figure 1B:
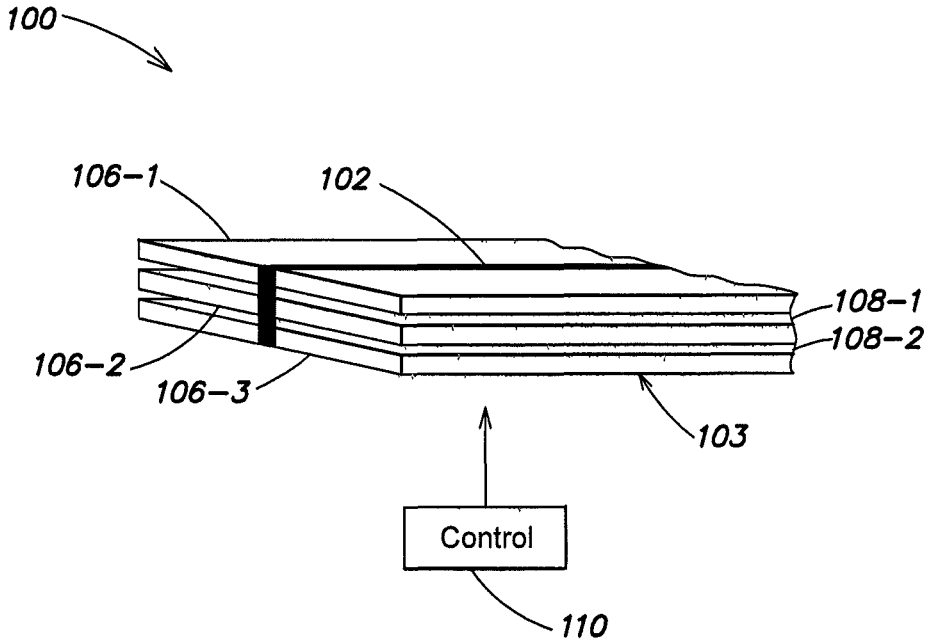
FIG. 1B is an isometric side view.
Figure 1C:
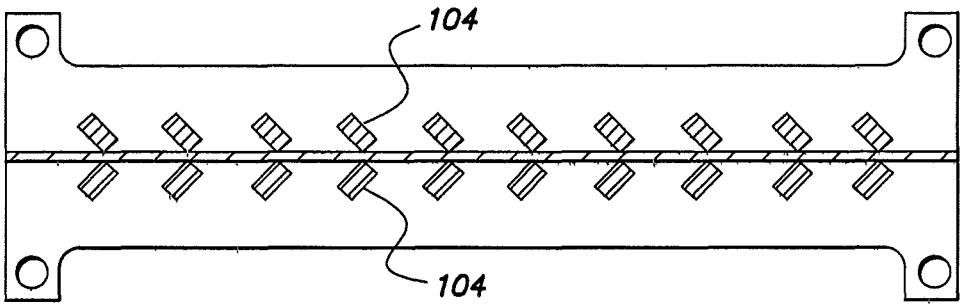
FIG. 1C is a top plan view.

FIGS. 1A to 1C illustrate one possible implementation of such a structure 100 using a quasi-TEM, non-dispersive microstrip transmission line 102. In this embodiment, three dielectric layers 106-1, 106-2, 106-3 spaced apart by adjustable gaps 108-1, 108-2. Spacing between the dielectric layers 106 is varied via some sort of control 110. Placed along the transmission line 102 at intervals are "taps" 104 such as the herring bone shaped elements pictured. As in this embodiment, these taps 104 can be used as the radiating elements themselves. Alternatively, as described below, the taps 104 can be used as a still further transmission line to feed some other radiating element. For the latter, various types of couplers can be used to tap power from the transmission line 102, with control over the division of power allowing for the implementation of an amplitude taper for sidelobe and beam control.

FIG. 1C shows the herringbone elements 104 in more detail, arranged as pairs of orthogonal conductive patches.

Figure 2A:
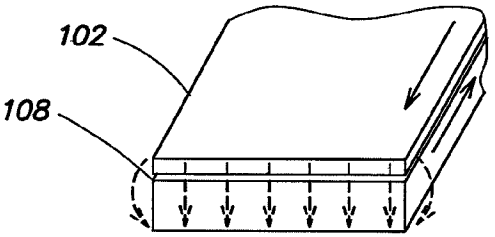
FIGS. 2A-2E illustrates various types of TEM and quasi-TEM transmission lines arranged adjacent a multi-layer controllable substrate.
Figure 2B:
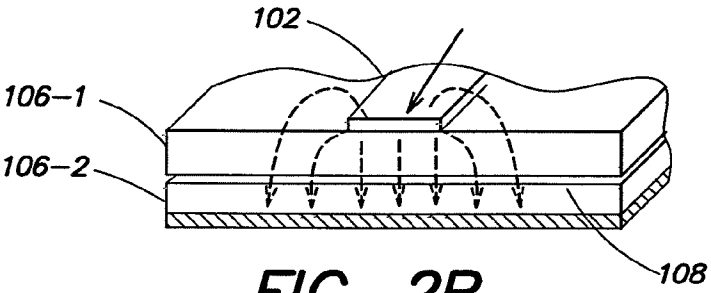
Figure 2C:
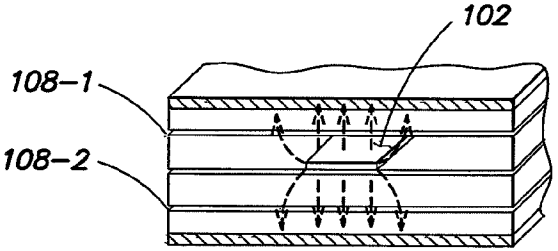
Figure 2D:
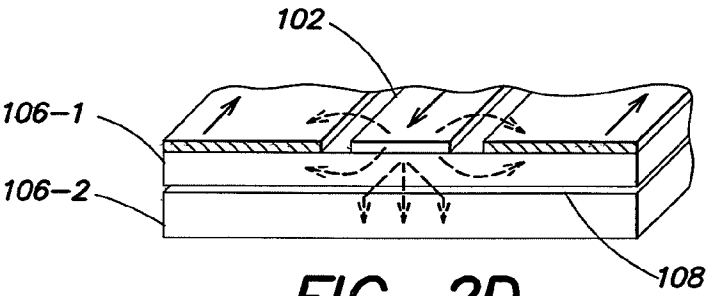
Figure 2E:
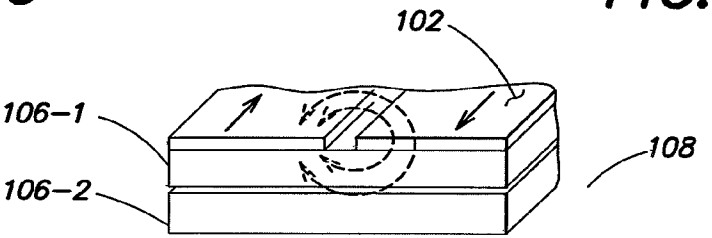

Other types of relatively non-dispersive, TEM and quasi-TEM transmission lines may be used, including parallel plate (FIG. 2A), microstrip (FIG. 2B), stripline (FIG. 2C), co-planar waveguide (FIG. 2D), and slot line (FIG. 2E). FIGS. 2A-2E illustrate a corresponding arrangement for an example position of a substrate 103 consisting of a pair of dielectric substrate layers 106 and single air gap 108 for each of the different types of transmission lines 102. Arrangements having more than two dielectric layers and more than a single air gap are contemplated as well.

The use of a non-dispersive, TEM-type transmission line is to be compared to the dielectric waveguide used in implementations described in the prior patent application referenced above. The TEM transmission line preferred herein exhibits little to no dispersion (β is constant over frequency), and thus provides broadband response albeit at the cost of being lossy. It can therefore be suitable for lower frequency operation, such as at L-band, where such loss is of less consequence.

Assuming constant phase progression and constant excitation amplitude across the taps, the direction of the resulting beam for such an array (in the elevational plane) is that of Equation (1):

$$\cos(\theta) = \frac{\beta TEM}{\beta \text{freespace}} - m\frac{\lambda}{d} \qquad \text{(Equation 1)}$$

where θ is the beam direction (with θ equaling 90 degrees corresponding to broadside), $\beta_{(TEM)}$ is the propagation constant of the TEM transmission line, $\beta_{(freespace)}$ is the propagation constant in air, d is the inter-element spacing of the array, m is the radiation mode number, and λ (lambda) is the wavelength.

Figure 3:
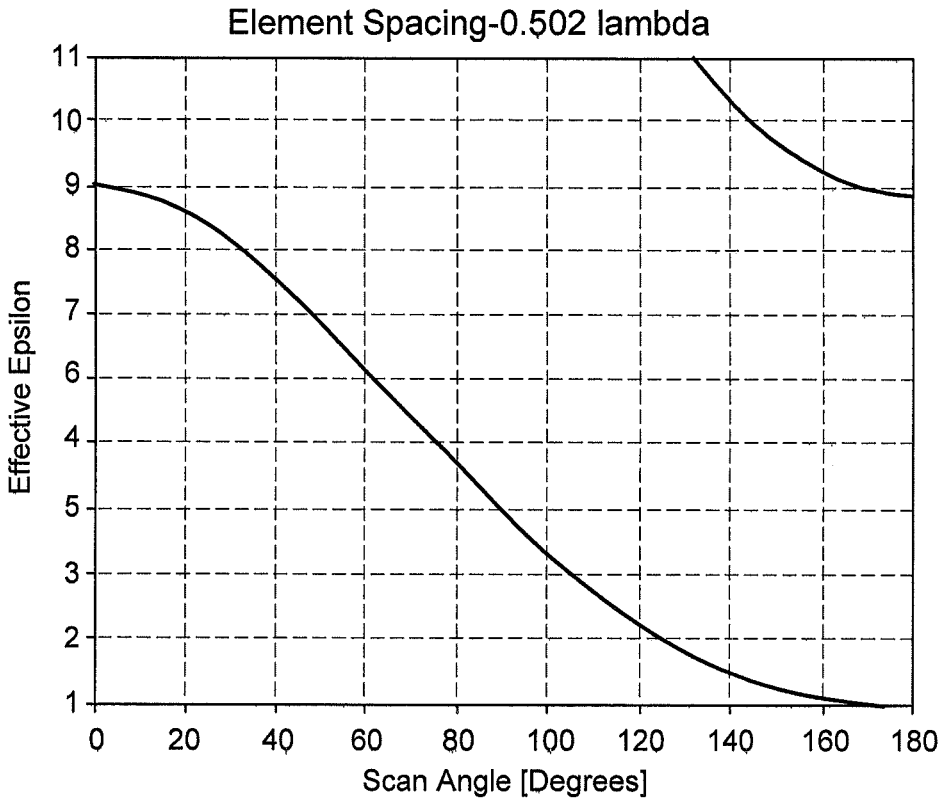
FIG. 3 is a plot of scan angle versus transmission line effective epsilon for a specific element spacing (~0.502λ).

For a fixed element spacing d=0.502 k, the plot of FIG. 3 indicates the resulting beam direction for the first radiation mode. It shows that, for a wave traveling in a medium with a wavelength equal to that in a relative epsilon material that can be varied from 9 to 1, up to a 170° beam shift can be incurred. This result is thus true for a wave traveling in a quasi-TEM or TEM line with a substrate having an effective dielectric constant (epsilon) that can be changed.

Figure 4:
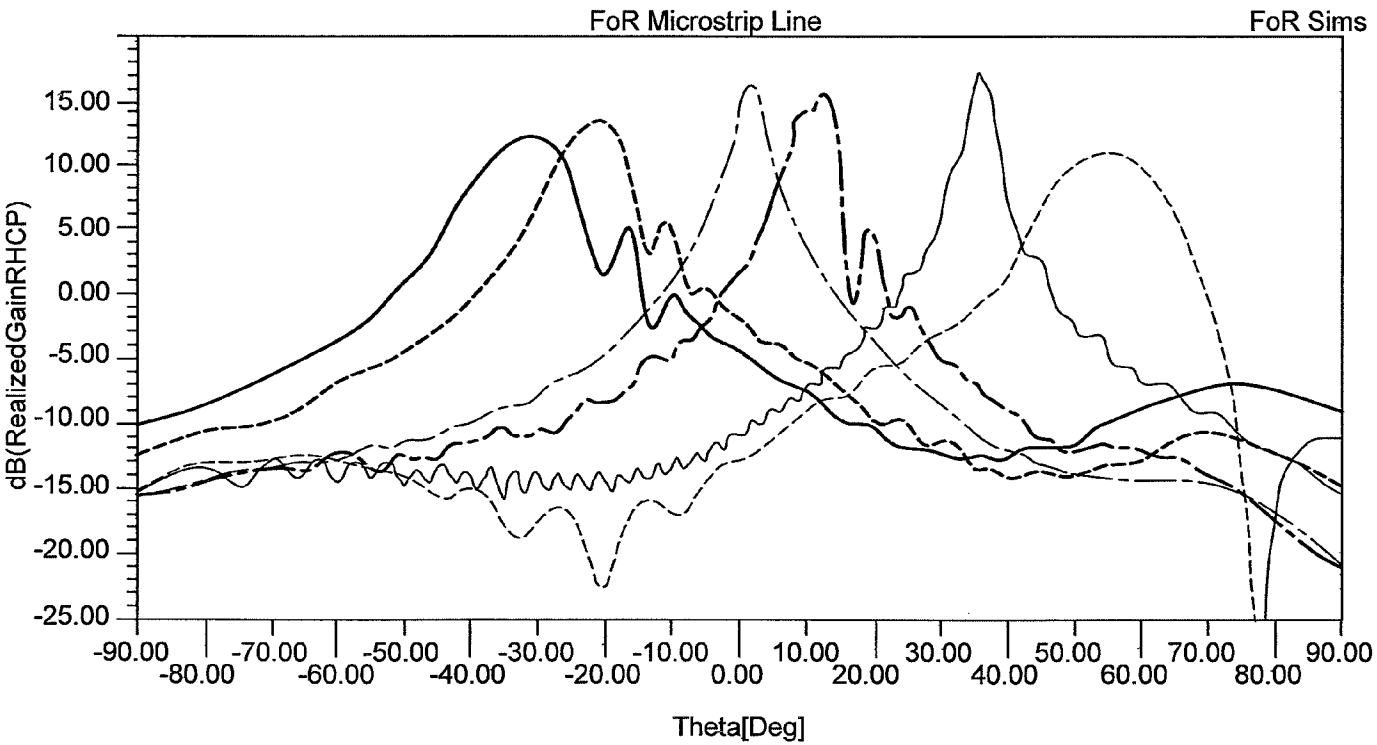
FIG. 4 shows elevation patterns derived from a model of the embodiment of FIGS. 1A-1C.

As an example of the scanning ability, a full-wave Finite Element Method (FEM) High Frequency Structural Simulator (HFSS) model was constructed of the microstrip/herring bone radiator implementation of FIGS. 1A-1C. The micro strip transmission line was disposed on a substrate of three (3) 10-mil Rogers® RO3010™ dielectric boards 106 (each having an Epsilon r=10.2). (Rogers® and RO3010 are trademarks of the Rogers Corporation of Rogers, Conn.). The air gaps 108 between the boards was varied from 0.0002 mils to 4 mils, and the beam scanned over 86 degrees. FIG. 4 shows the resulting elevation patterns for different gap spacings (See FIG. 4).

As mentioned briefly above, the taps 102 may take different forms, including but not limited to direct conductive, transformer current divider, and TEM coupler types.

Figure 5:
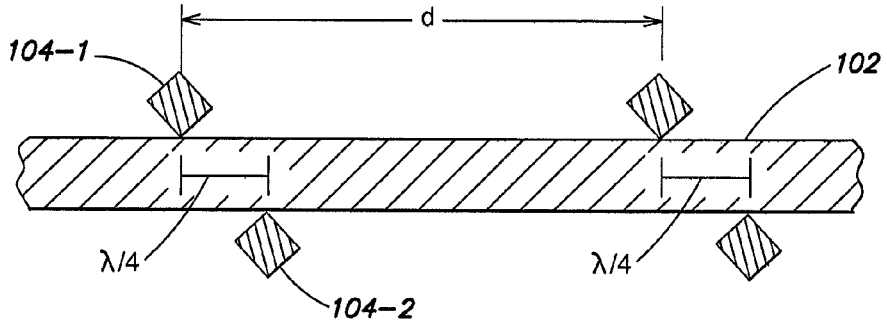
FIG. 5 is a more detailed view of a pair of orthogonal herringbone taps and their effective λ/4 spacing in the transmission line.

FIG. 5 illustrates a direct conductive approach for the taps 102. This is a more detailed view of FIG. 1C, where the taps 104 are pairs of conductive patches directly touching the transmission line at spaced intervals, d. Note the spacing between immediate orthogonal elements 104-1, 104-2 is λ/4, to achieve an effective quadrature feed from the transmission line at each interstitial location.

Figure 6:
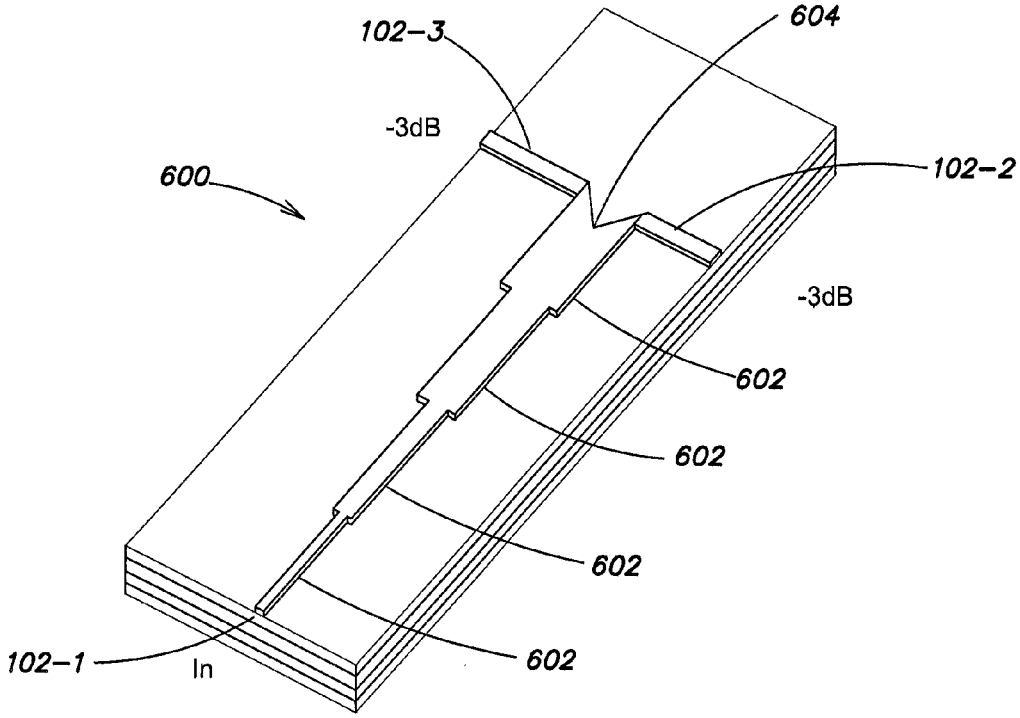
FIG. 6 is an example transformer coupler.

Alternatively, a transformer coupler approach may use a series of impedance transformers to achieve the division of power to each tap location. FIG. 6 is an example of such a transformer 600, where a series of stepped transitions 602 reduce the impedance increasingly from an input line 102-1 until a split occurs at junction 604. At this junction 604, the two output TEM line sections 102-2, 102-3 are in parallel with their parallel impedance is matched to the last section of the transformer 600. An unequal power division can be achieved by using differing impedance output lines 102-2, 102-3, which divide the current proportionally to their impedance. Amplitude taper can be achieved by controlling the impedance of the different output lines along the array.

Figure 7B:
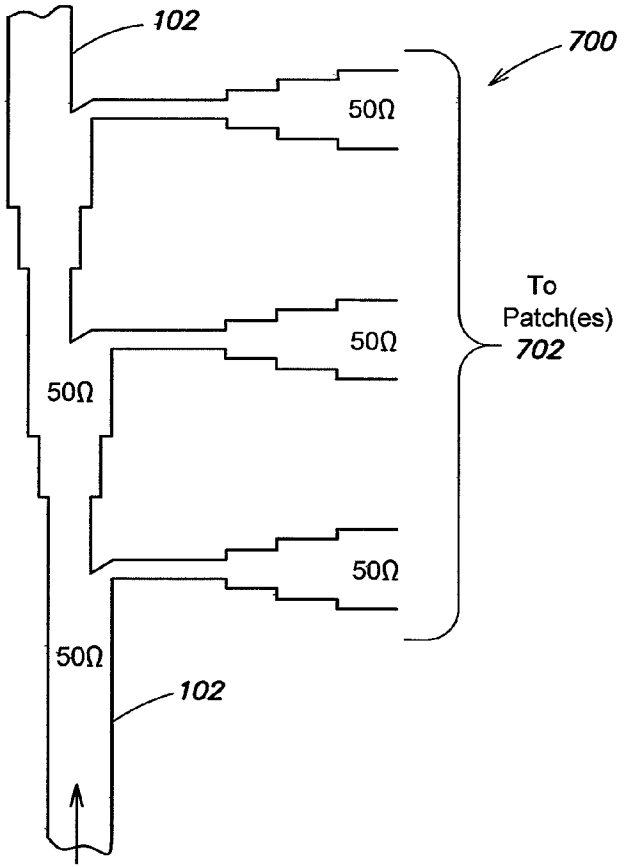
FIGS. 7A and 7B illustrate a network of transformer couplers.
Figure 7A:
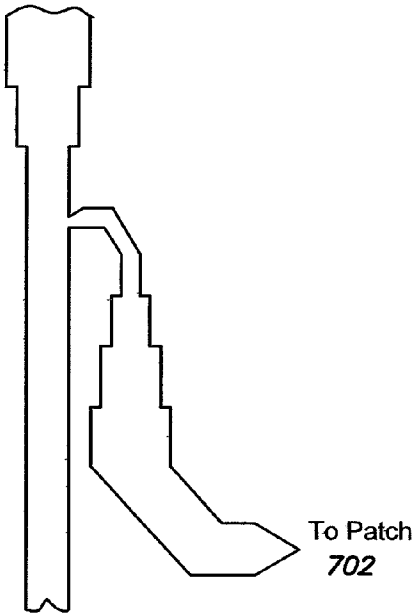

The sketches of FIGS. 7A and 7B show a more detailed implementation of the transformer approach using patch radiators 702. After each tap point, the series line 102 is preferably restored to its original impedance in preparation for the next tap, so there are series transformers on the main line as well as the output lines.

Figure 8:
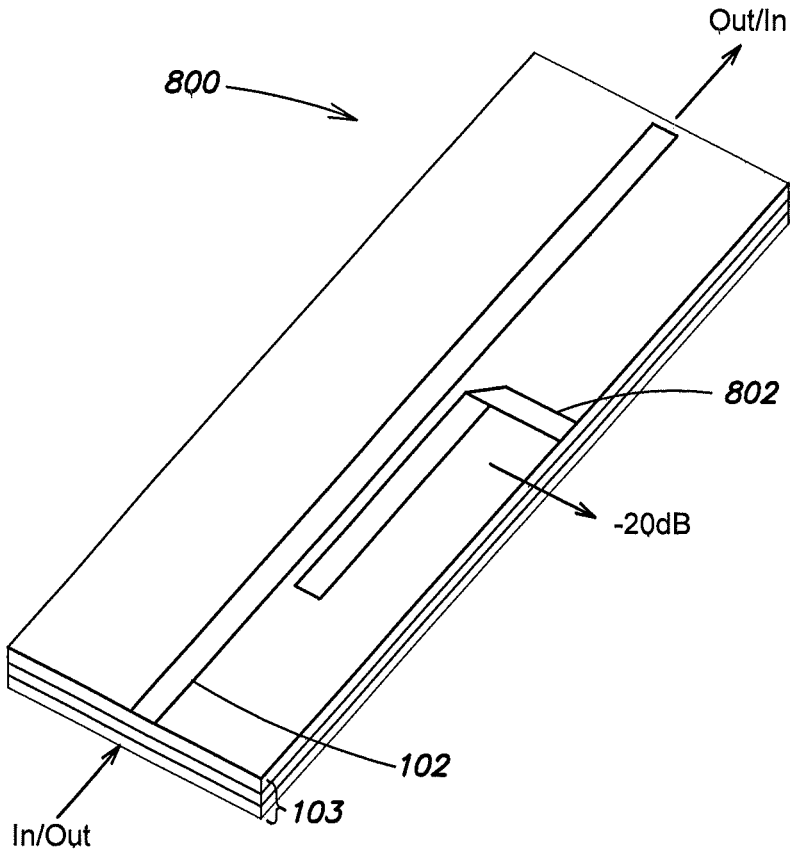
FIG. 8 is an example TEM coupler.

Another arrangement for taps 104 is a TEM coupler as shown in FIG. 8. This coupler has no direct connection between the main series line 102 and the tap line 802, they are instead coupled through fringe fields within the substrate. The proximity to the main line 102 and length of the parallel tap 802 section provide control over the coupling level. The TEM coupler 802 can be edge coupled, broadside coupled, or any combination thereof.

Regardless of the tap method, the lines are fed to pairs of radiating elements arranged to provide a circularly polarized (CP) radiation pattern with the input to two nominally quadrature feeds. Because the adjacent orthogonal taps are spaced nominally at quarter wave increments (λ/4) along the TEM line (wavelength at mid gap size), the lines provide quadrature feeds to the elements. Additionally, because the elements are spaced at a quarter wave when the gaps are mid sized (when the beam passes through boresight) the bandstop phenomenon normally seen with traveling wave antennas does not exist. This is because the reverse reflection, if any, off the taps to the TEM line is cancelled by the next tap because the two waves meet at antiphase.

Any of the coupler approaches of FIG. 7A, FIG. 7B or FIG. 8 may provide some advantages over the direct conductive approach of FIG. 6. In particular, although the direct conductive approach is simpler to implement, discrete couplers such as FIG. 7A, 7B or 8 may provide advantages when the return loss is high in the main transmission line 102, even as the impedance of the transmission line is changed.

Another consideration in series-fed traveling waves antennas is known as the photonic bandgap, where if couplers or radiators are spaced at d=λ/2 in the transmission line, the reflections back towards the source add up in phase and cause a high Voltage Standing Wave Ratio (VSWR).

This high VSWR effect may be mitigated in two ways.

First, couplers/radiators may be at lambda/4 (λ/4) along the transmission line such that the reflection off one element is cancelled with the next (the elements must be spaced at λ/4 as the beam passes through broadside). Broadside is the beam position that would be excited by elements being spaced at λ/2 and feeds in-phase, or in the λ/4 case, every other element spaced at λ/2. In one embodiment, locating couplers off the transmission line spaced at λ/4 can be used to feed a quadrature radiation network. Examples of this may be a dual-quadrature-fed circularly polarized patch or orthogonal linear patches.

Second, one can implement a well-matched coupler such as the transformer network or TEM coupler of FIGS. 7A, 7B and 8. Models have shown that couplers like those shown above can have return loss as low as −35 dB. The return loss then is high, and the reflections that add in phase are thus low, resulting in a very low loss value so the photonic bandgap is limited to an acceptable level. Also, couplers can have a low return loss even as transmission line characteristics are changed.

As discussed above, when the beam is scanned along the array axis, the far field scan angle (θ) is a function of frequency (see Equation 1). In a case as herein, where a TEM transmission line exhibits low dispersion (β is constant with frequency). As such, the TEM transmission line embodiments described herein provide little beam squint over the channel bandwidth. It is therefore the element spacing that is primarily responsible for causing beam squint (the λ/d term). This frequency dependence can be mitigated, and the antenna made to have a larger instantaneous bandwidth, with implementation of a progressive delay at each element location. The delays provide a frequency dependent phase shift between the power dividers (couplers 702,802) and the radiators. Implementation of progressive delay in this way is expected to allow instantaneous bandwidths of 1 Ghz or higher.

Figure 9:
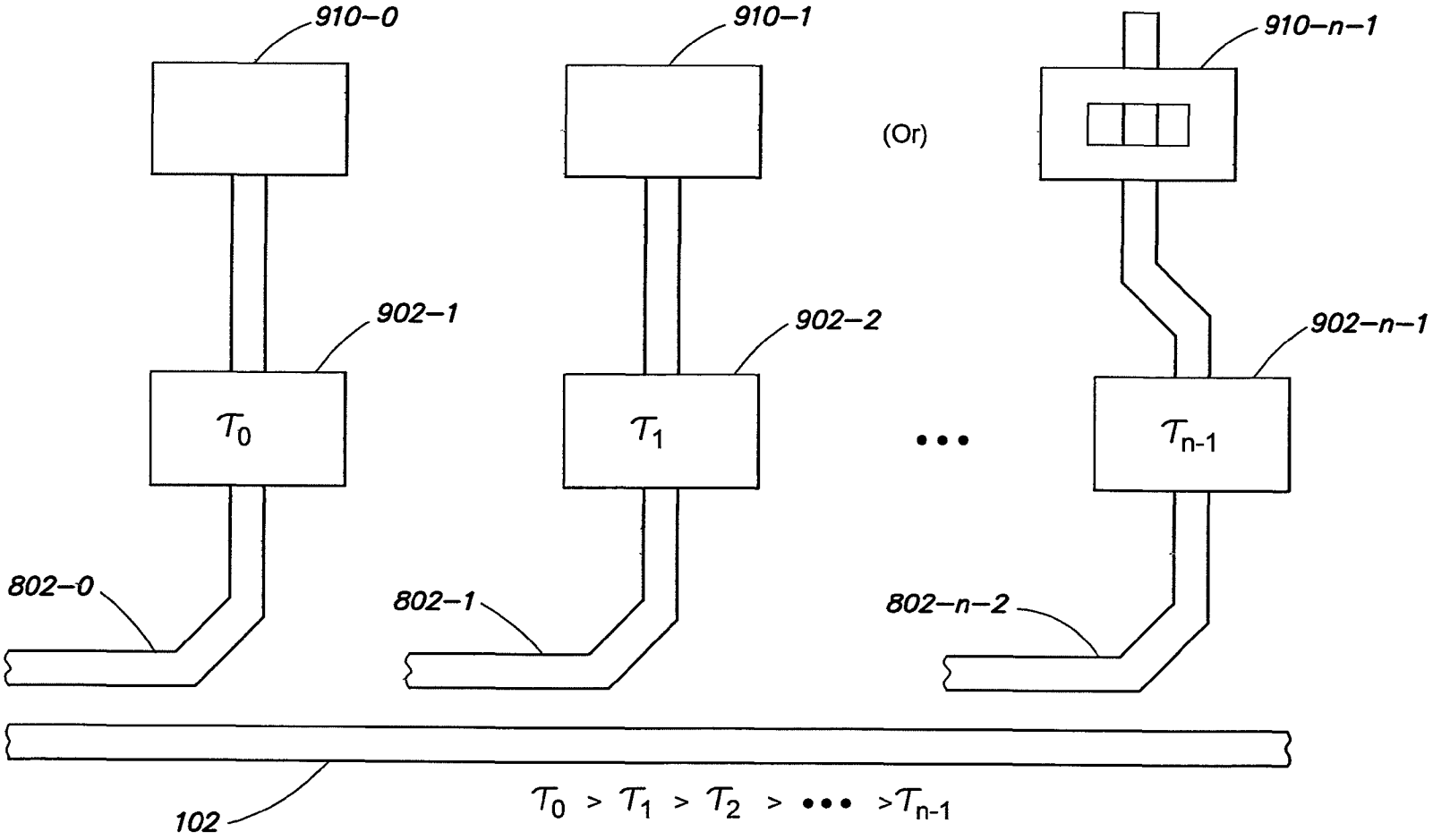
FIG. 9 is an example feed using TEM couplers on each tap with interposed progressive delay elements.

See FIG. 9 for an example implementation of progressive delays placed 902 between TEM couplers 802 and radiating elements 910. Note here also that radiators 902 be any sort of radiator such as a conductive, a patch, a slot fed patch, or some other radiating structure.

In one embodiment, delay lines 902 have a electrical length set to equalize the delay from the source of the transmission line to each element radiator. Another embodiment to implement high-Q filters for the same purpose.

The above structure can also be implemented without radiators. This can then be used as a variable delay power divider, which can be designed to have radio Frequency (RF) outputs. In this embodiment, the variable delay power divider may be used to feed any radiating elements or RF components, including but not limited to other line arrays, to scan them in an orthogonal dimension.

Figure 10:
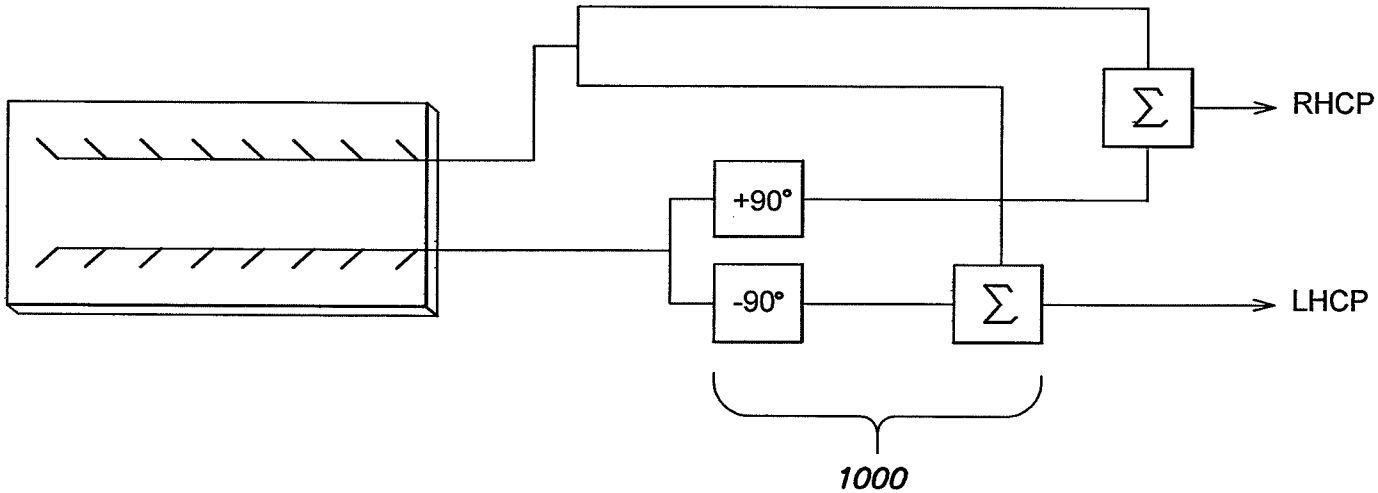
FIG. 10 is an embodiment using a pair of transmission lines with dual quadrature couplers providing Right Hand Circular Polarization (RHCP) and Left Hand Circular Polarization (LHCP).

FIG. 10 illustrates using a pair of transmission lines with the structure of FIG. 1A fed in quadrature to provide simultaneous Right Hand Circularly Polarized (RHCP) and Left Hand Circularly Polarized (LHCP) feeds.

Figure 11:
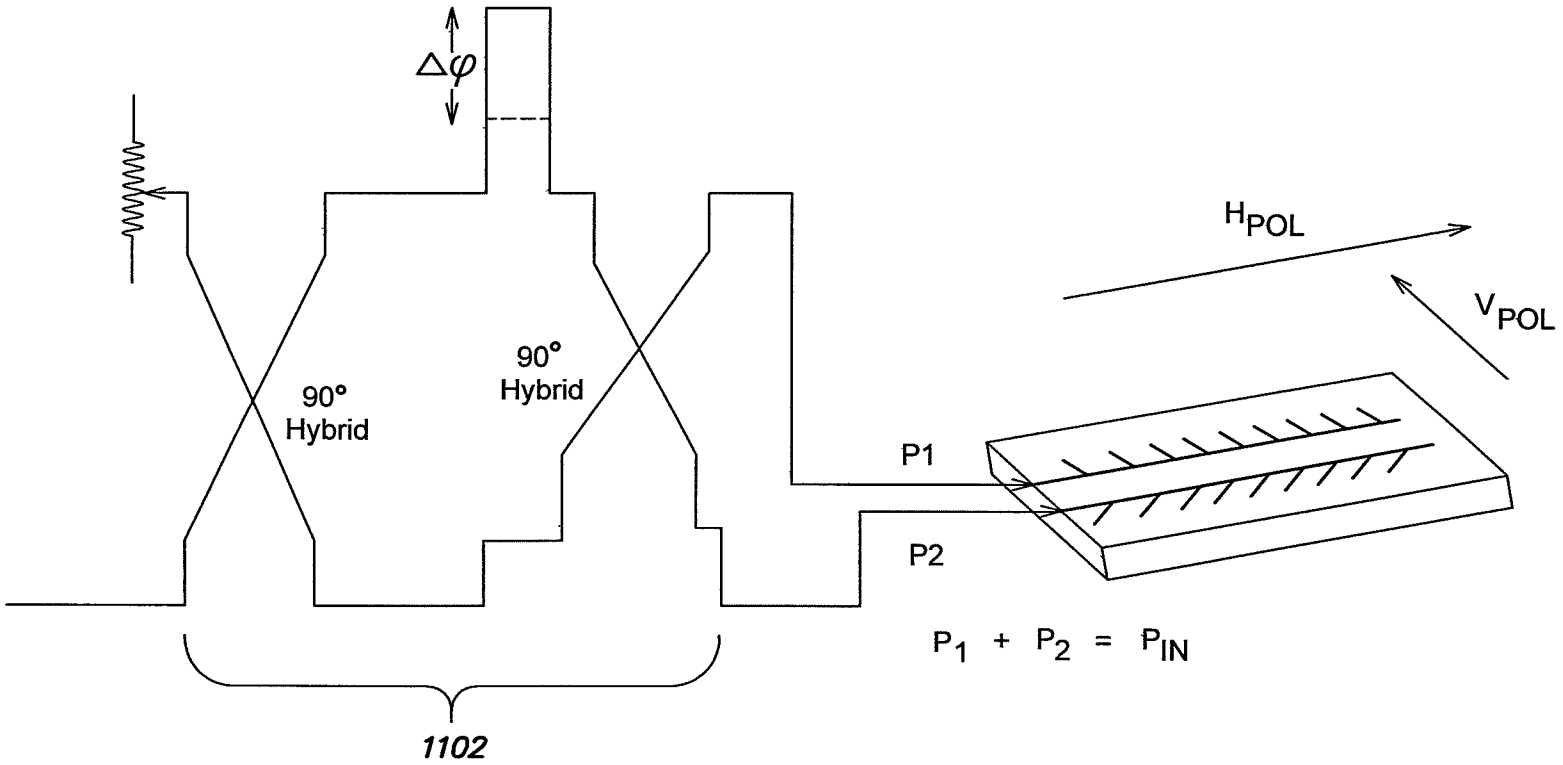
FIG. 11 is an implementation providing arbitrary polarization using a pair of transmission lines.

FIG. 11 illustrates a feed arrangement using a pair of the transmission lines with a variable power divider 1110 to radiate any arbitrary polarization. Variable power divider 1110 may use a variable impedance, variable phase shifter, and pair of hybrid combiners, as shown, or may be any suitable circuit providing variable power division.

What is claimed is:

1. An apparatus comprising:

a transverse electromagnetic mode (TEM) transmission line composed of a non-dispersive, elongated planar conductor;

a dielectric structure disposed beneath the TEM transmission line, the dielectric structure having an adjustable wave propagation constant; and a series of antenna coupling taps, each coupling tap composed of a planar conductor disposed in a same plane as the planar conductor of the TEM transmission line, with the coupling taps further disposed such that there is a series of coupling taps on both sides of the TEM transmission line.

2. The apparatus of claim 1 wherein the dielectric structure further comprises multiple dielectric material layers spaced apart by gaps.

3. The apparatus of claim 2 additionally comprising a control element arranged to adjust a size of the gaps, and thereby affect a change in a beam angle, where the control element may be a piezoelectric, electroactive material or a mechanical position control.

4. The apparatus of claim 1 additionally comprising a delay element connected to each of two or more of the coupling taps, wherein a delay introduced by respective delay elements changes with a respective position of each coupling tap along the TEM transmission line.

5. The apparatus of claim 4 wherein a cumulative additional delay introduced by the delay elements cancels a delay introduced by the TEM transmission line.

6. The apparatus of claim 1 wherein the non-dispersive, elongated TEM transmission line is one of a stripline, microstrip, parallel plate, or slot line.

7. The apparatus of claim 1 wherein the coupling taps are positioned in orthogonal pairs, and a first coupling tap of each pair located on a first side of the transmission line is spaced apart from a second coupling tap of each pair on a second side of the transmission line by ¼ λ, where λ is an operating wavelength.

8. The apparatus of claim 1 wherein each coupling tap couples the TEM transmission line to a radiating antenna element.

9. The apparatus of claim 1 wherein the coupling taps are radiating elements.

10. The apparatus of claim 8 wherein each coupling tap is a transformer coupler with tapered widths.

11. The apparatus of claim 8 wherein each coupling tap is a TEM mode coupler.

12. The apparatus of claim 1 additionally comprising a second planar TEM transmission line disposed in the same plane as the series of coupling taps.

13. The apparatus of claim 12 additionally comprising a feed network, coupled to at least one of the TEM transmission lines to control polarization.

14. The apparatus of claim 13 additionally wherein the feed network controls RHCP and LHCP.

* * * * *